US005224315A

United States Patent [19]

Winter, IV

[11] Patent Number: 5,224,315

[45] Date of Patent: Jul. 6, 1993

[54] PREFABRICATED BUILDING PANEL HAVING AN INSECT AND FUNGICIDE DETERRENT THEREIN

[76] Inventor: Amos G. Winter, IV, Pinnacle Springs Rd., Spofford, N.H. 03462

[21] Appl. No.: 876,920

[22] Filed: Apr. 30, 1992

Related U.S. Application Data

[63] Continuation of Ser. No. 538,143, Jun. 14, 1990, abandoned, which is a continuation-in-part of Ser. No. 384,150, Jul. 21, 1989, abandoned, which is a continuation-in-part of Ser. No. 273,685, Nov. 21, 1988, Pat. No. 4,907,383.

[51] Int. Cl.[5] ..... E04C 1/00

[52] U.S. Cl. ..... 52/309.8; 52/309.9; 428/218; 428/402.24

[58] Field of Search ..... 52/309.8, 309.9, 309.11; 428/402.24, 316.6, 218

[56] References Cited

U.S. PATENT DOCUMENTS

| | | | |
|---|---|---|---|
| 5,170 | 6/1847 | Preston | 52/89 |
| 2,535,883 | 12/1950 | Williamson | 52/224 |
| 2,897,668 | 8/1959 | Graham | 52/81 |
| 3,138,898 | 6/1964 | Carter | 52/408 |
| 3,390,211 | 6/1968 | Ziegler | 52/224 |
| 3,443,347 | 5/1969 | Varnell | 52/224 |
| 3,464,168 | 9/1969 | Russell | 52/86 |
| 3,466,821 | 9/1969 | O'Shaughnessy | 52/593 |
| 3,520,092 | 7/1970 | Petrik | 52/80 |
| 3,763,608 | 10/1973 | Chamlee | 52/80 |
| 3,919,444 | 11/1975 | Shayman | 428/95 |
| 4,023,317 | 5/1977 | Bettger | 52/80 |
| 4,291,088 | 9/1981 | Wolff | 428/311.5 |
| 4,425,065 | 1/1984 | Sweeney | 411/23 |
| 4,557,970 | 12/1985 | Holtrop | 428/316.6 |
| 4,655,013 | 4/1987 | Ritland | 52/80 |
| 4,686,804 | 8/1987 | Smith | 52/80 |
| 4,764,420 | 8/1988 | Gluck | 264/45.3 |
| 4,804,578 | 2/1989 | Crookston | 428/304.4 |
| 4,871,477 | 10/1989 | Dimanshteyn | 428/406 |
| 5,060,426 | 10/1991 | Jantzen | 52/86 |

FOREIGN PATENT DOCUMENTS

| | | | |
|---|---|---|---|
| 762542 | 7/1971 | Belgium | 52/309.9 |
| 91534 | 4/1982 | European Pat. Off. | 52/89 |
| 2525539 | 12/1976 | Fed. Rep. of Germany | 52/612 |
| 81730 | 7/1919 | Switzerland | 52/612 |
| 1525983 | 9/1978 | United Kingdom | 52/80 |
| 2130620 | 6/1984 | United Kingdom | 52/80 |

OTHER PUBLICATIONS

Computer search which includes abstract from 5 patents (1) JP 54048877 (2) SU 1038349 (3) JP 88-97270 (4) JP 78-127897 (5) JP 73-47088 25.

*Primary Examiner*—Henry E. Raduazo

[57] ABSTRACT

A prefabricated building panel, sometimes referred to as a stress skin panel, having a core which may be comprised of a single layer or may have multiple layers of material and into which core is incorporated, or encapsulated, borates in the form of borate compounds similar to TIM-BOR ® in an amount (typically between about 2 weight percent and about 10 weight percent) which results in a core material which deters the entry of and the infestation of ants and other insects thereby enhancing and improving the usefulness of such prefabricated building panels. The addition of the borate compound has also been found to act as a fungicide and further flame retardant properties of the building panel are improved. Borate may be added, if possible, into the core material of any known prefabricated construction/building panel. However, it is most advantageous and effective if the borate is added during the fabrication of the core of the panel.

29 Claims, 2 Drawing Sheets

PREFABRICATED BUILDING PANEL HAVING AN INSECT AND FUNGICIDE DETERRENT THEREIN

BACKGROUND OF THE INVENTION

This is a continuation of application Ser. No. 538,143, filed Jun. 14, 1990 now abandoned which is a continuation-in-part of U.S. patent application Ser. No. 384,150 filed on Jul. 21, 1989, now abandoned which in turn is a continuation-in-part of U.S. patent application Ser. No. 273,685 filed on Nov. 21, 1988, now U.S. Pat. No. 4,907,383 which issued on Mar. 13, 1990.

FIELD OF THE INVENTION

This invention relates to the field of prefabricated wall, roof and floor panels having incorporated or encapsulated therein additives which deter ant and insert infestation and additionally may act as a fungicide and enhances the fire retardant characteristics of the panels. More particularly this invention relates to the encapsulation of a borate compound within the core material of single or multi-layered core prefabricated building panels. The multi-layered panels are as described in Applicant's copending application Ser. No. 384,150 and the single layered panels are as described in Applicant's U.S. Pat. Nos. 4,907,383 and 4,833,855. The panels so described may be fabricated in a novel way from smaller panel pieces, so as to continue the skin strength (both compression and tensile) and which panels may have incorporated novel means for more securely, efficiently and economically joining such panels to form either structural/load bearing walls or non-structural/-non-load bearing walls which may be highly insulative with substantially no thermal bridges. The multi-layered panel has a highly insulative multi-layered core located adjacent to one skin or alternatively located between two skins bonded to or otherwise rigidly affixed to the two outside surfaces of the core. The core of the multi-layered panel has a plurality of core layers which may be of the same or of different foam plastic materials. The layers of the core located adjacent to the panel skins provide a thermal barrier for the middle or second core layer which middle layer may be of a thermoplastic such as styrofoam and also may provide the means for bonding or securely affixing the panel skins to the surface of the multi-layered core. The borate, which is typically in the form of a powder (a borate compound used has been TIM-BOR ® a product manufactured by U.S. Borax Corporation), may be incorporated into all of the layers of the panel. However, it is most important that the borate be encapsulated within the first and the third layers that is, the layers adjacent to the skins of a panel having two skins.

The panels may be flat or planar or the panels may have a bowed configuration and when assembled in edge-to-edge relationship with complementary mating edges i.e., which edges abuttingly match the edges of similarly configured adjacent panels, form a bowed roof or a bowed wall of a structure such as the bowed roof in a so called "BOWED ROOF CAPE" or "BOWED CAPE".

DESCRIPTION OF THE PRIOR ART

The rising cost of labor and materials have made building construction and especially the construction of homes increasingly more expensive. In addition the cost of heating and cooling a building has increased many times over in recent years. In order to keep the costs of construction, heating, cooling and maintenance within reasonable limits and therefore affordable to the general public, innovations have been necessary. In part because of the availability of prefabricated structure-wall and curtain-wall panels of the type discussed herein and in Applicant's U.S. Pat. Nos. 4,907,383 and 4,833,855, there have been a return to the post and beam type of modular construction which lends itself to a prefabrication of the many construction components away from the construction site. By prefabricating and precutting many of the components of the structure at a manufacturing facility, many procedures may be used to improve the fabrication efficiency and improve the quality of the components as well as reduce the construction time.

Prefabricated panels that may or may not be load bearing are provided at the construction site and are designed to be used with the post and beam construction. The panels which do not carry a load are sometimes referred to as curtain wall panels and can be used to rapidly enclosed the post and beam frame. The exterior or outer skin of the panel is provided ready for siding to be applied and the inside or inner skin of the panel is provided ready for application of any desired interior finish. Currently the panels, whether they are structure-wall panels (load bearing) or curtain-wall panels (non-load bearing), are connected one to the other along the vertical edges of the panels by what is referred to as splines or stud posts. These splines or stud posts unfortunately introduce thermal bridges. Further, the joint of adjacent wall so joined by the stud posts, whether by mechanical or by gluing means, do not continue the strength of the panel skins. In U.S. Pat. No. 4,578,909 smaller than normal load bearing panels are shown assembled without the use of stud posts. Such an assembly requires that the panels have either the foam insulation extend beyond the panel skins or the panel skins extend beyond the foam insulative core. The two types of panel edges can then be alternatively abutted and fastened, by glueing for example, to form a wall. It should be clearly noted that the assembled wall does not provide for a panel or wall skin which has continuous strength from panel to panel. Prefabricated structure-wall and curtain-wall panels which provide the advantages over the prior art are defined and discussed in Applicant's U.S. Pat. No. 4,833,855.

Presently, homes which have bowed walls and/or bowed roofs are constructed using, in the instance of the bowed roof, rafters which are cut, awn or laminated to have the appropriate arc or radius to create the bowed roof configuration. The roof skin is then constructed over or between the rafters using conventional and well known construction methods. Likewise, the inner surface had to be finished if the inner surface of the roof was to be a finished surface or a decorates surface. Where appropriate, insulation was also incorporated into the roof.

There are also available homes and/or structures which have roofs which are bowed inwardly or in other words concave instead of convex. Again, the known methods of conventional construction require the use of a relatively complex framing system of concave rafters etc. The roof skin is constructed similarly to the roof for the convex or bowed roof structure and similarly for a structure having a domed roof. The bowed panels defined and described in Applicant's U.S. Pat. No.

4,907,383 provide the advantages needed to construct the bowed roofs and walls of a building.

It would be advantageous to provide a multi-layered core prefabricated insulative building panel which would not require the use of an additional component such as a spline or stud post to attach panels to form a larger panel or wall. In addition to the stud posts being an additional component they also reduce the effective insulative property of the completed building because they create thermal bridges. Thus the elimination of the stud post or splines improves the thermal efficiency of the completed building in addition to enhancing the construction efficiency and reducing the cost. In addition, it would be desireable to have multi-layered core building panels similarly made but which would have a bowed configuration allowing for the construction with such panels of bowed walls, bowed/convex or domed roofs and concave roofs (collectively referred to herein as non-planar walls or non-planar roofs) without the need to fabricate, by lamination or by other well known means, bowed rafters and other similarly configured components which make up the relatively complex framing system. The advantages of bowed roofs and bowed walls are relatively obvious to those of ordinary skill in the art of home or building design and construction. Among some of the advantages are increased living space and permitting new design variations with prefabricated panel construction. Where the bowed multi-layered core prefabricated panels are structural panels, it is possible to construct a bowed roof or a bowed wall for example without the need for bowed rafters and a bowed wall stud configuration thereby, for the bowed roof, increasing the useable space available on the second and the third level of the building. Bowed non-structural prefabricated panels having proper joining systems incorporated therein could readily be used as curtain wall (non-structural) panels or placed over bowed roof rafters and would therby eliminate the construction step of insulating the roof when the panel is provided with a multi-layered insulative foam core. Such panels which solve these problems are described in Applicant's copending application Ser. No. 384,150.

In U.S. Pat. No. 4,373,312 there is described a prefabricated panel construction system using self-drilling threaded fasteners, metal strips embedded in the panels to provide anchors for the threaded fasteners and specially adapted unsulating member along one edges of each panel to provide mechanical support. In U.S. Pat. No. 4,625,472 there is described a lightweight structural building panel having a shape compatible for use in assembling a geodesic dome structure. It is important to note that the panels do not have a bowed configuration and could not be used in the manner described herein.

It is also important to note that many of the prefabricated building panels currently in use have, as a core material, styrofoam/styrene or other forms of thermoplastic foam. The core of these panels melts very quickly in the presence of high temperature and as a result the panels lose their structural integrity very quickly. The panels described in applicant's copending application Ser. No. 273,685 and applicant's U.S. Pat. No. 4,833,855 have a homogeneous insulative core material, and where the core material is a thermosetting material such a urethane the panel cores do not melt when exposed to high heat. However, the panels are more expensive and heavier than panels having a thermoplastic core. Also, in order to foam-in-place the urethane foam and to also use the urethane foam to bond the skin or skins to the homogeneous urethane core, it is necessary to heat the foam for a fairly long time. The panels of the present invention overcome the disadvantages of these prior art panels. The multi-layered core building panel provides the thermal protection, provides the fastening means i.e., the bonding and improves the strength of the panel and the stability of the panel skins. Additionally, since the layers adjacent to the skins does not constitute the entire core, the time to foam and bond the skin and the second or inner core layer is reduced. A panel according to the present invention could have a metal skin, a thermosetting foam plastic core layer bonded to the skin and to a second core layer of a thermoplastic foam. The thermosetting foam layer would provide an effective thermal barrier between the metal skin and the styrofoam core. I.e., it would extend the period of time at which the styrofoam core would melt and become structurally unstable in the presence of high heat.

Associated with all of the prefabricated construction panels discussed above there is the problem of ant infestation. While standard methods may be employed to eliminate the presence of ants and termites and other insects which attack wooden structures, where prefabricated panels are used it is difficult to introduce pesticides and fungicides into the core regions of the panels. It would be extremely advantageous to be able to incorporate or encapsulate a material or compound into the core of the panel which would deter the infestation of insects.

SUMMARY OF THE INVENTION

The present invention, in its most simple embodiment, is directed to a prefabricated building panel, sometimes referred to as a stress skin panel, having a core which may be comprised of a single layer or may have multiple layers of material and into which core is incorporated, or encapsulated, borates in the form of borate compounds in an amount (typically between about 2 weight percent and about 10 weight percent) which results in a material which deters the entry of and the infestation of ants and other insects thereby enhancing and improving the usefulness of such prefabricated building panels. The addition of the borate compound has also been found to act as a fungicide and is also flame retardant. Borate may be added, if possible, into the core material of any known prefabricated construction/building panel. However, it is most advantageous and effective if the borate is added during the fabrication of the core of the panel especially the panels defined by Applicant's U.S. Pat. Nos. 4,833,855 and 4,907,383 and the multi-layered panels defined in Applicant's copending application Ser. No. 384,150 wherein the layer or layers are typically of uniform thickness which may vary or taper over the length and/or the width of the panel and which material is bonded to at least one adjacent skin. The combination of the core and skin is preferably but not necessarily basically rectangular in shape and it may be bowed from one shorter edge to the other shorter edge or from one longer edge to the other longer edge. The edges of the panels are configured to abuttingly match corresponding edges of similarly configured panels.

The first layer of the multi-layered core is a thermosetting foam plastic such as urethane, phenolics, isocyanurate or other cross-linked or thermoset type of foam. The second layer may be of the same material as layer one in which case layer two may be pre-made into typically a rectangular sheet form and placed into position so that when the first layer is foamed the second layer becomes securely affixed to one surface of the first layer and the other surface of the first layer securely attaches to the surface of the skin. Where there are three layers, the first and the third layers are adjacent to the skins and the second layer in positioned between the first and the third. The first and third layers also provide the bonding or the means for securely affixing the skins to the multi-layered core and provide a thermal shield and thereby extends the life of the panel when exposed to a high temperature environment. The borate, which is typically in the form of a powder (a borate compound used has been TIM-BOR ®, Disodium Octaborate Tetrahydrate, a product manufactured by U.S. Borax Corporation), may be incorporated into all of the layers of the panel. However, it is most important that the borate be encapsulated within the first and third layers that is, the layers adjacent to the skins of a panel having two skins.

In the event that thicker and larger prefabricated insulative panels are needed, the use of the multi-layered core of this invention permits the fabrication of such panels. The second layer of the core can be preformed and positioned between the skins. Since the first and third thermosetting foam layer do not form the entire core thickness it is easier and more feasible to foam-in-place these two layers effectively bonding the skins to the multi-layered core. There is no loss in the insulative quality of the panel and in fact the skin stability is enhanced.

It is important to note that, when the panels are assembled to form a wall or a roof assembly, the strength of the skins are continued from panel to panel without the need for stud posts or the like. When the surfaces of the joints are tightly joined using a fastening means, such as for example glue, the tensile and compression forces are continued through the joint region from panel skin to panel skin and the wall has the character of a single continuous surface.

It is an object of the invention to provide an improved prefabricated building panel having a core of foam plastic material and having two opposed surfaces, the core having edges defining thereby the size of the panel and at least one skin each having a predetermined thickness and each skin sized substantially the same as and securely affixed to at least one of the surfaces the improvement comprising: between about 1 weight percent and about 20 weight percent of a borate compound encapsulated within the foam plastic material. The foam plastic material is preferably a thermoset foam plastic but maya be a thermoplastic foam plastic.

It is a primary object of the invention to provide a prefabricated building panel comprising a core of a plurality of layers of foam plastic material the core comprising a first layer being a thermoset type of foam plastic having between about 1 weight percent and about 20 weight percent of a borate compound encapsulated therein and having two opposed surfaces, one of the two opposed first layer surfaces securely affixed to a first surface of a second foam plastic layer the core having edges defining thereby the size of the panel; and a skin having a predetermined thickness and sized substantially the same as and securely affixed to another of the first layer surfaces.

Another primary object of the invention is to provide a prefabricated building panel comprising: a core of a plurality of layers of foam plastic material, at least one of the plurality of layers of foam plastic material having between about 1 weight percent and about 20 weight percent of a borate compound encapsulated therein, the core comprising a first layer being thermoset foam plastic and having two opposed surfaces, one of the two opposed first layer surfaces securely affixed to a first surface of a second foam plastic layer, a third layer of thermoset foam plastic material having two opposed surfaces one third layer surface securely affixed to a second surface of the second foam plastic layer, the core having two opposed and substantially vertical core edges, and two opposed and substantially horizontal core edges defining thereby the size of the panel; an inner skin having a predetermined thickness and sized substantially the same as and securely affixed to another of the third layer surface; and an outer skin having a predetermined thickness and sized substantially the same as and securely affixed to another of the first layer surface.

A further primary object of the present invention is to provide the prefabricated building panel wherein the second foam plastic layer is a thermoset foam plastic.

A yet further primary object of the present invention is to provide the prefabricated panel described wherein the inner skin and/or the outer skin is material selected from waferboard, oriented strand board, fiberboard, plastic board, sheetrock, wood panel, wire, wire reinforced paper, pressboard, particle board, plywood, metal, plastic, fiber reinforced concrete and poly-concrete, alone or in multilayered combinations thereof.

A still further primary object of the present invention is to provide panels as described wherein the second foam plastic layer is a thermoplastic foam plastic such as for example styrofoam.

Yet another primary object of the present invention is to provide panels as described wherein the first and third thermoset foam plastic layers have a thickness of between about ⅛ inch and about 1 inch and each having between about 1 weight percent and about 20 weight percent of a borate compound encapsulated therein.

Another object of the present invention is to provide a method for deterring the infestation of a prefabricated building panel by ants and other wood affecting insects by encapsulating a borate compound into a core material of the building panel the core being a foam plastic, the method comprising: adding between about 1 weight percent and about 20 weight percent of the borate compound into at least one component of the foam plastic; agitating to evenly disperse the borate compound throughout the at least one component of the foam plastic to form a first mix; rapidly and evenly interspersing a predetermined amount of the first mix with a predetermined amount of remaining components of the foam plastic forming a second mix which upon curing forms the foam plastic; and causing the second mix to cure onto and be attached to at least one skin of the building panel. The foam plastic core material may be thermoset foam plastic and the at least one component is substantially polyol and the remaining component is substantially isocyanate. The predetermined amounts of the first mix and the remaining components being about equal. Alternatively the foam plastic core material may be a thermoplastic foam plastic selected from the group consisting of extruded styrene, expanded polystyrene and poly-vinyl-chloride and the at least one component is substantially a thermoplastic resin prior to the forming of beads which beads are used to form the thermoplastic foam core thereby encapsulating the borate compound within the thermoplastic foam core.

These and further objects of the present invention will become apparant to those skilled in the art after a study of the present disclosure of the invention.

DESCRIPTION OF THE PREFERRED EMBODIMENTS

In order to more clearly describe and disclose the invention, building panels having foam plastic types of core materials will be used. The types of panels are those illustrated in FIGS. 1–2 which are meant to be only representative of the types of panels into which the invention may be incorporated. The panels which will be used as example panels are described as having substantially uniform thickness, rectangular in shape, a multi-layered foam plastic insulative core of uniform thickness and bonded to one or to two skins. Clearly, the core need not be multi-layered. The core of the panel, whether multi-layered or of a single layer of material, may be made out of thermoplastic foams such as expanded polystyrene (EPS), styrofoam, extruded styrene, PVC or phenolics, urethane, or any of the variety of isocyanurate plastic foams. The skins will be shown made of typically one of the standard materials but it should be noted that the skin or the skins may be made from combinations of skin materials. The combination may be and most typically will be laminated or layered form. But clearly there could be a mixture of materials in other than layered form where the material would so permit.

Figure 1:
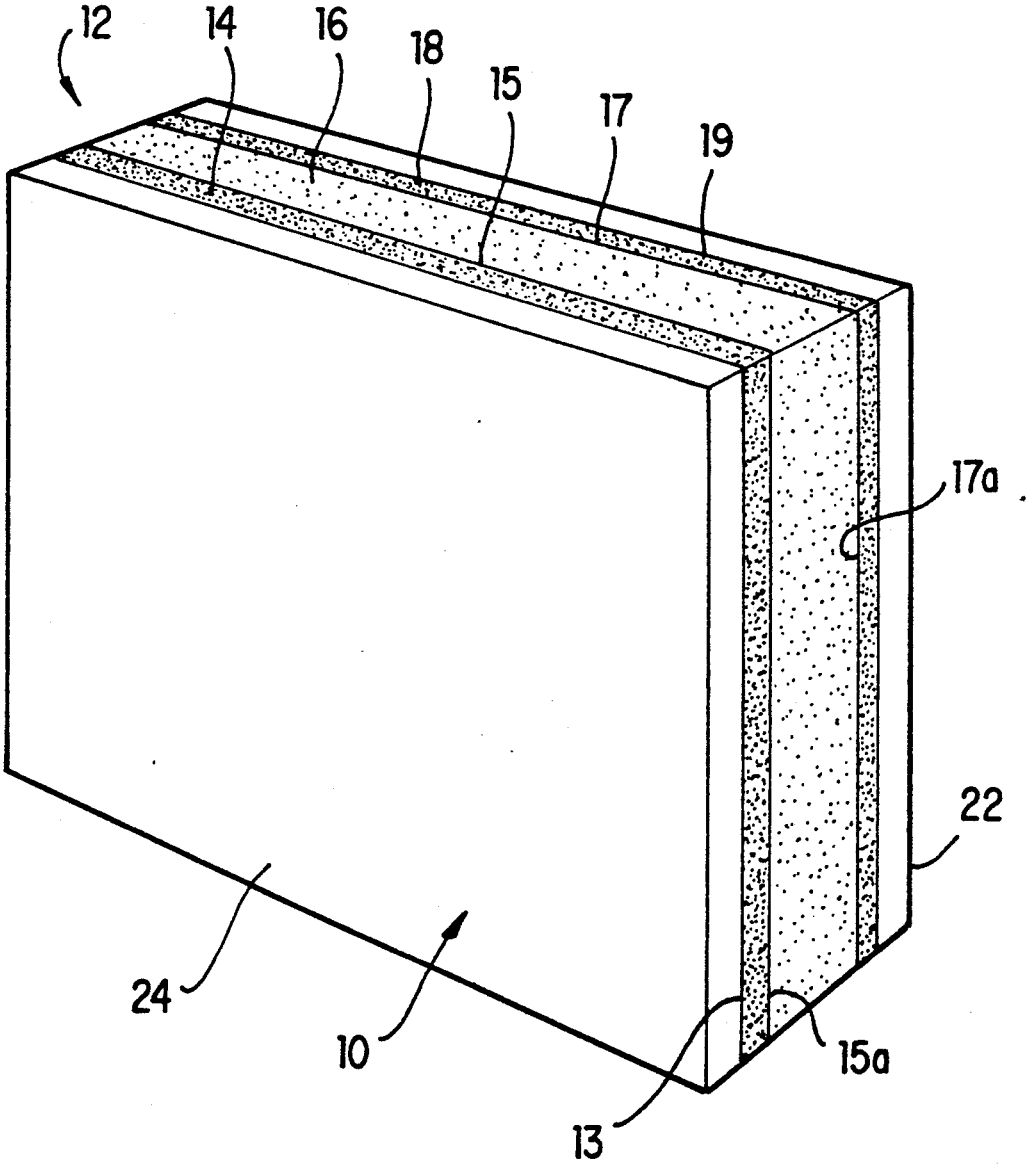
FIG. 1 is a perspective view of the multi-layered core prefabricated building panel having an outer skin and an inner skin according to the present invention.

Referring now to the embodiment shown in FIG. 1 which illustrates a prefabricated panel 10 having two (2) skins 22 and 24 and a multi-layered core 12 having a first layer 14, and second layer 16 and a third layer 18. Typically the first and the third layer 14 and 18 will have TIM-BOR® encapsulated within each of these foam layers; however, it may be advantageous, depending upon the application of the panels, to have borate with only one layer or within all three layers. The skin 24 is securely affixed at the inner surface to another first layer surface 13. The one first layer surface 15*a* is affixed to first surface 15 of the second layer 16. The second surface 17 of second layer 16 is affixed or bonded to one surface 17*a* of a third layer 18. The other surface 19 of the third layer is affixed or bonded to the inner surface of the inner skin 22.

Figure 2:
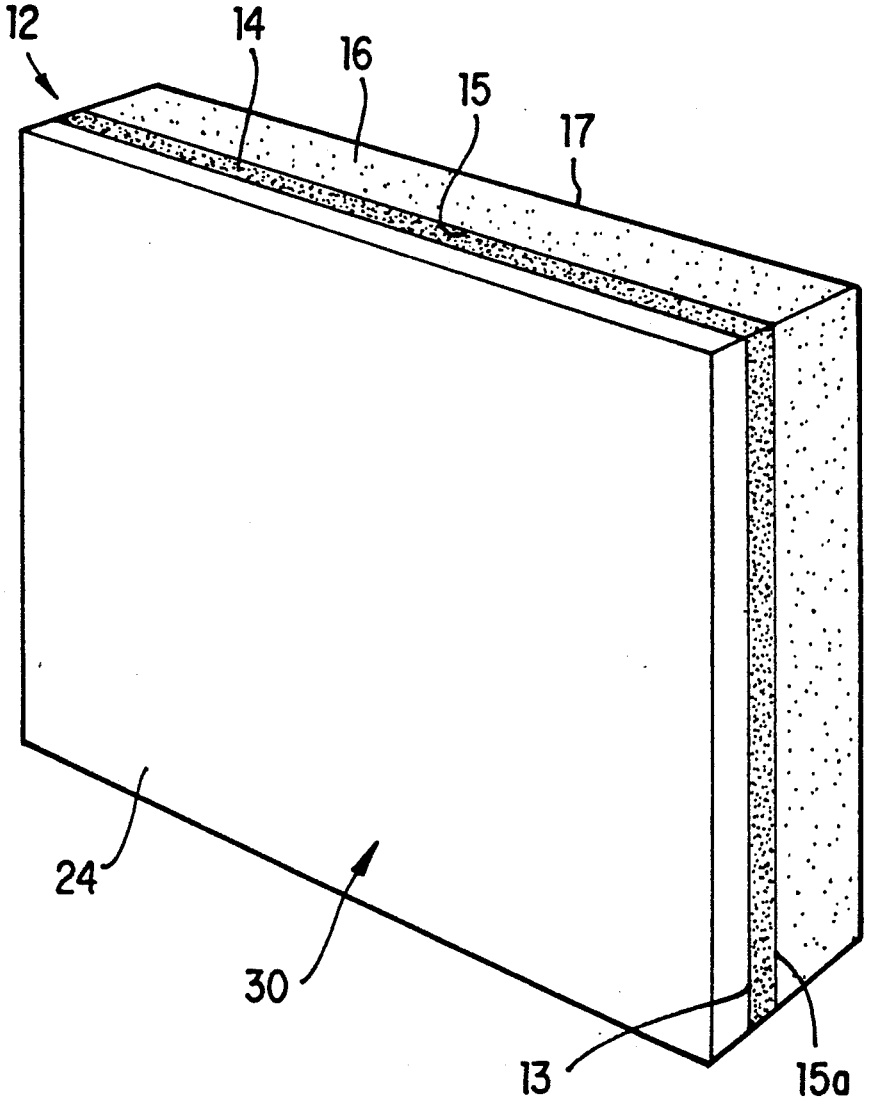
FIG. 2 is a perspective view of the multi-layered core prefabricated building panel having one skin according to the present invention.

The embodiment shown by FIG. 2 is a prefabricated panel 30 which is similar in every respect to the panel 10 except that there is only one skin 24 and the core 12 comprises a first layer 14 and a second layer 16 and typically the first layer 14 would have the borate compound encapsulated within. However, it is also within the scope of the invention to encapsulate the borate compound within both the first and the second layers 14 and 16.

In the preferred embodiment of the invention, a borate compound such as TIM-BOR® is encapsulated within the core portion of the panels 10 and 30. These panels have an insulative, typically foam plastic, multi-layered core 12 which core 12 has substantially uniform thickness bonded to an outer skin 24 as in FIG. 2 and to an outer skin 24 and an inner skin 22 as shown in FIG. 1. The typical material from which the first and the third layers are made is urethane. However, any thermosetting foam, that is foam which does not melt when exposed to high temperature, may be used. Some thermosetting foams have a temperature at which foaming is triggered and there may be advantages to using such foams when making the panels of this invention. Further, some thermosetting foams provide for better bonding to the surfaces 15 and 17 of second layer 16 and to the inside surfaces of skins 22 and 24. The exact formulation of thermosetting foam for use in core 12 will depend upon many factors. However, all of such foam are within the scope of the present invention.

It is of course understood that the second layer 16 of the core 12 may be material other than an insulative material such as for example a paper honeycomb or any other material which could function as a core for the panels. However, the preferred material of second layer 16 is a foam plastic which is highly insulative such as styrofoam or styrene or extruded polystyrene. The outer skin 24 may be material, preferably, such as plywood, wafer board, particle board or oriented strand board or material over which siding or roof shingles may be attached. The inner skin 22 may be, preferably, gypsum board, plywood or other material which may be used for the interior wall or ceiling covering or as the base for the finished interior wall or ceiling.

The panel is usually fabricated having a generally rectangular configuration. The edges define the size of the panel 10. The skins 22 and 24 are typically attached to the core 12 when the core 12 is fabricated. After the panel 10 or 30 is fabricated, a joint may be machined, or molded or cut into the appropriate edges of the panel 10 or 30 in such a manner so that when panels are assembled together in edge-to-edge relationship the adjacent edges of the assembled panels abuttingly match. Where in-the-field assembly is to be used a micro encapsulated adhesive may be applied to at least one of the edges of the panels 10 or 30. Upon assembling panels 10 or 30 in order to form walls, or roofs it has been found that the captured scarf joint permits the effective assembly of panels 10 or 30 using only the adhesive. It has been observed that because of the special angles and unique characteristics of the captured scarf joint, the panels 10 or 30 being joined, are captured, very easily aligned and securely held in postion. In addition to the larger bonding area provided by the captured scarf joint the joint is not tight until it is completely closed thereby causing a very tight and continuous, from panel to adjacent panel, inner skin 22 and outer skin 24. That is to say that the inner and the outer skins of joined panels being tight and continuous is meant to convey the notion that the skin strength from panel to panel appears or behaves as a continuous skin without joints would behave from a structural and a strength standpoint.

The method used in making the core material with the borate compound encapsulated within is substantially as follows: (1) add between about 1 weight percent and about 20 weight percent of the borate compound into at least one component of the foam plastic and where isocyanurate foam is being used the borate is added to the polyol component; (2) the combination is stirred or agitated to evenly disperse the borate compound throughout the polyol component of the foam plastic; (3) this first mix is rapidly and evenly interspersed in substantially equal amounts by weight with the remaining components of the foam plastic, which in the case of an isocyanurate foam is isocyanate, forming a second mix which upon curing forms the foam plastic; and (4) this second mix is caused to cure using catalysts and methods well known to those of ordinary skill and the curing is caused to take place onto and be attached to at least one skin of the building panel. Alternatively the foam plastic core material may be thermoplastic foam plastic selected from the group consisting of extruded styrene, expanded polystyrene and poly-vinylchloride and the borate compound is mixed with a thermoplastic resin prior to the forming of beads which beads are used to form the foam core thereby encapsulating the borate compound within the thermoplastic foam core. The plastic beads having the borate encapsulated within may be used to produce the extruded styrene, the expanded polystyrene and other types of thermoplastic foam products useful as core material for prefabricated building panels. It should be noted that the borate could be introduced into the resin before or during the expansion or the extrusion process. It is important only that the borate be encapsulated within the basic foam and not simply distributed along the boundaries of beads which form, for example, a styrene sheet of material. Where the borate is at such boundaries, moisture very quickly reduces the effectiveness of the borate as an insect deterrent within the building panel.

It is thought that the prefabricated wall, roof and floor panels having incorporated or encapsulated therein additives which deter ant and insect infestation and additionally may act as a fungicide and improve the flame retardant characteristics of the panel and more particularly the addition or borate to the core material of improved single or multi-layered core prefabricated building panels and many of its attendant advantages including its use in making the panels more flame and smoke suppressing, will be understood from the foregoing description and it will be apparent that various changes may be made in the form, composition of compounds construction and arrangement of the parts and compounds thereof without departing from the spirit and scope of the invention or sacrificing all of its material advantages, the form hereinbefore described being merely a preferred or exemplary embodiment thereof.

I claim:

1. A prefabricated building panel comprising:

a core of a plurality of layers of foam plastic material, said plurality of layers comprising a substantially dense first layer substantially free of voids to the extent that fluids cannot pass through said dense first layer having substantially uniform thickness of between about 0.125 and 1.000 inches being thermoset foam plastic having between about 1 weight percent and about 20 weight percent of a borate compound encapsulated therein and having two opposed surfaces, one of said two opposed first layer surfaces securely affixed to a first surface of a second foam plastic layer said core having edges defining thereby the size of said panel; and a skin hard and dense relative to said core and wherein said hard, dense skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete having having a predetermined thickness and sized substantially the same as and securely affixed to another of said first layer surfaces.

2. The prefabricated building panel according to claim 1 wherein said second foam plastic layer is a thermoset foam plastic.

3. The prefabricated building panel according to claim 1 wherein said second foam plastic layer is a thermoplastic foam plastic.

4. The prefabricated building panel according to claim 3 wherein said skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete.

5. The prefabricated building panel according to claim 3 wherein said skin is material selected from a layered combination of at least two of the following: waferboard, oriented strand board, fiberboard, plaster board, sheetrock, wood panel, wire, wire reinforced paper, pressboard, particle board, plywood, metal, plastic, fiber reinforced concrete and poly-concrete.

6. The prefabricated building panel according to claim 2 further comprising said second foam plastic layer having between about 1 weight percent and about 20 weight percent of a borate compound encapsulated therein.

7. The prefabricated building panel according to claim 3 further comprising said second foam plastic layer having between about 1 weight percent and about 20 weight percent of a borate compound encapsulated therein.

8. A prefabricated building panel comprising:

a core of a plurality of layers of foam plastic material, at least one of said plurality of layers of foam plastic material having between 1 weight percent and about 20 weight percent of a borate compound encapsulated therein said core comprising: a substantially dense first layer substantially free of voids to the extent that fluids cannot pass through said dense first layer being thermoset foam plastic having substantially uniform thickness of at least about one-half inch, and having two opposed surfaces, one of said two opposed first layer surfaces securely affixed to a first surface of a second foam plastic layer, a substantially dense third layer substantially free of voids to the extent that fluids cannot pass through said dense third layer, of thermoset foam plastic material having substantially uniform thickness of at least about one-half inch and having two opposed surfaces one third layer surface securely affixed to a second surface of said second foam plastic layer, said core having two opposed and substantially vertical core edges, and two opposed and substantially horizontal core edges defining thereby the size of said panel;

an inner skin, hard and dense relative to said core, and having a predetermined thickness and sized substantially the same as and securely affixed to another of said third layer surface;

a hard, dense outer skin, hard and dense relative to said core, and having a predetermined thickness and sized substantially the same as and securely affixed to another of said first layer surface.

9. The prefabricated building panel according to claim 8 wherein said second foam plastic layer is a thermoset foam plastic.

10. The prefabricated building panel according to claim 8 wherein said second foam plastic layer is a thermoplastic foam plastic.

11. The prefabricated building panel according to claim 9 wherein said inner skin and said outer skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete.

12. The prefabricated building panel according to claim 10 wherein said inner skin and said outer skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete.

13. The prefabricated building panel according to claim 9 wherein said first and third thermoset foam plastic layers have a thickness of between about ⅛ inch and about 1 inch and each having between about 1 weight percent and about 20 weight percent of a borate compound encapsulated therein.

14. The prefabricated building panel according to claim 10 wherein said first and third thermoset foam plastic layers have a thickness of between about ⅛ inch and about 1 inch and each having between about 1 weight percent and about 20 weight percent of a borate compound encapsulated therein.

15. A prefabricated building panel comprising:

a core of a plurality of layers of foam plastic material comprising: a substantially dense first layer substantially free of voids to the extent that fluids cannot pass through said dense first layer being thermoset foam plastic having substantially uniform thickness of between about 0.125 and 1.000 inches and having two opposed surfaces, one of said two opposed first layer surfaces securely affixed to a first surface of a second foam plastic layer said core having edges defining thereby the size of said panel; and a skin of hard and dense relative to said core and wherein said hard, dense skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete having a predetermined thickness and sized substantially the same as and securely affixed to another of said first layer surfaces.

16. The prefabricated building panel according to claim 15 wherein said second foam plastic layer is a thermoset foam plastic.

17. The prefabricated building panel according to claim 15 wherein said second foam plastic layer is a thermoplastic foam plastic.

18. A prefabricated building panel comprising:

a core of a plurality of layers of foam plastic material comprising: a substantially dense first layer substantially free of voids to the extent that fluids cannot pass through said dense first layer being thermoset foam plastic having substantially uniform thickness of at least about one-half inch, and having two opposed surfaces, one of said two opposed first layer surfaces securely affixed to a first surface of a second foam plastic layer, a substantially dense third layer substantially free of voids to the extent that fluids cannot pass through said dense first layer of thermoset foam plastic material having substantially uniform thickness of at least about one-half inch and having two opposed surfaces one third layer surface securely affixed to a second surface of said second foam plastic layer, said core having two opposed and substantially vertical core edges, and two opposed and substantially horizontal core edges defining thereby the size of said panel;

an inner skin hard and dense relative to said core and having a predetermined thickness and sized substantially the same as and securely affixed to another of said third layer surface;

an outer skin hard and dense relative to said core and wherein said outer skin is material selected from waferboard, oriented strand board, fiberboard, plastic board, sheetrock, wood panel, wire, wire reinforced paper, pressboard, particle board, plywood, metal, plastic, fiber reinforced concrete and poly-concrete having a predetermined thickness and sized substantially the same as and securely affixed to another of said first layer surface.

19. The prefabricated building panel according to claim 18 wherein said second foam plastic layer is a thermoset foam plastic.

20. The prefabricated building panel according to claim 18 wherein said second foam plastic layer is a thermoplastic foam plastic.

21. The prefabricated panel according to claim 18 wherein said inner skin is material selected from; waferboard, oriented strand board, fiberboard, plaster board, sheetrock, wood panel, wire, wire reinforced paper, pressboard, particle board, plywood, metal, plastic, fiber reinforced concrete and poly-concrete.

22. The prefabricated panel according to claim 19 wherein said outer skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete.

23. The prefabricated panel according to claim 19 wherein said inner skin and said outer skin is material selected from; waferboard, oriented strand board, fiberboard, plaster board, sheetrock, wood panel, wire, wire reinforced paper, pressboard, particle board, plywood, metal, plastic, fiber reinforced concrete and poly-concrete.

24. The prefabricated panel according to claim 20 wherein said outer skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete.

25. The prefabricated panel according to claim 20 wherein said inner skin and said outer skin is material selected from; waferboard, oriented strand board, fiberboard, plaster board, sheetrock, wood panel, wire, wire reinforced paper, pressboard, particle board, plywood, metal, plastic, fiber reinforced concrete and poly-concrete.

26. The prefabricated panel according to claim 22 wherein said first and third thermoset foam plastic layers have a thickness of between about ⅛ inch and about 1 inch.

27. The prefabricated panel according to claim 16 wherein said first and third thermoset foam plastic layers have a thickness of between about ⅛ inch and about 1 inch.

28. An improved prefabricated building panel having a core of a plurality of layers of foam plastic material said core comprising a substantially dense first layer substantially free of voids to the extent that fluids cannot pass through said dense first layer said first layer being thermoset foam plastic having substantially uniform thickness of at least about one-half inch, and having two opposed surfaces, one of said two opposed first layer surfaces securely affixed to a first surface of a second foam plastic layer said core having edges defining thereby the size of said panel and a skin hard and dense relative to said core and wherein said hard, dense skin is material selected from waferboard, oriented strand board, fiberboard, plaster board, sheetrock, wood panel, wire, wire reinforced paper, pressboard, particle board, plywood, metal, plastic, fiber reinforced concrete and poly-concrete, said hard, dense skin having a predetermined thickness and sized substantially the same as and securely affixed to another of said first layer surfaces said improvement comprising: between about 1 weight percent and about 20 weight percent of a borate compound encapsulated within at least one layer of said plurality of layers of foam plastic material.

29. An improved prefabricated building panel having a core of a plurality of layers of foam plastic material said core comprising; a substantially dense first layer substantially free of voids to the extent that fluids cannot pass through said dense first layer said first layer being thermoset foam plastic having substantially uniform thickness of at least about one-half inch, and having two opposed surfaces, one of said two opposed first layer surfaces securely affixed to a first surface of a second foam plastic layer, a substantially dense third layer substantially free of voids to the extent that fluids cannot pass through said dense third layer and said third layer being thermoset foam plastic material having substantially uniform thickness of at least about one-half inch and having two opposed surfaces with one third layer surface securely affixed to a second surface of said second foam plastic layer, said core having two opposed and substantially vertical core edges, and two opposed and substantially horizontal core edges defining thereby the size of said panel; being a hard, dense inner skin, hard and dense relative to said core, and having a predetermined thickness and sized substantially the same as and securely affixed to another of said third layer surface; a outer skin, which is hard and dense relative to said core, and having a predetermined thickness and sized substantially the same as and securely affixed to another of said first layer surfaces wherein said hard, dense inner skin and outer skin is material selected from; waferboard, oriented strand board, fiberboard, plastic board, sheetrock, wood panel, wire, wire reinforced paper, pressboard, particle board, plywood, metal, plastic, fiber reinforced concrete and poly-concrete said improvement comprising: between about 1 weight percent and about 20 weight percent of a borate compound encapsulated within at least one layer of said plurality of layers of foam plastic material.

* * * * *